US009526384B2

(12) United States Patent
Laflin

(10) Patent No.: US 9,526,384 B2
(45) Date of Patent: Dec. 27, 2016

(54) WET OR DRY WIPE DISPENSER AND CONTAINER

(71) Applicant: Barbara Diaz Laflin, Ocean Ridge, FL (US)

(72) Inventor: Barbara Diaz Laflin, Ocean Ridge, FL (US)

( * ) Notice: Subject to any disclaimer, the term of this patent is extended or adjusted under 35 U.S.C. 154(b) by 76 days.

(21) Appl. No.: 14/487,246

(22) Filed: Sep. 16, 2014

(65) Prior Publication Data

US 2015/0053712 A1 Feb. 26, 2015

Related U.S. Application Data

(63) Continuation of application No. 29/415,032, filed on Mar. 6, 2012, now Pat. No. Des. 713,266.

(51) Int. Cl.

| | |
|---|---|
| ***B65D 83/08*** | (2006.01) |
| ***B65H 1/00*** | (2006.01) |
| ***A47K 10/24*** | (2006.01) |
| ***A47K 10/38*** | (2006.01) |
| *A47K 10/32* | (2006.01) |

(52) U.S. Cl.

CPC ..... *A47K 10/3818* (2013.01); *B65D 83/08* (2013.01); *A47K 2010/3266* (2013.01)

(58) Field of Classification Search

USPC .. 206/494, 389, 409, 233, 210, 390; 221/46, 33, 63, 135, 306, 303; 225/106, 52; 292/89, 85; 220/814, 262, 322, 756, 318, 220/212.5, 755, 722, 315; 312/34.8; 222/558

See application file for complete search history.

(56) References Cited

U.S. PATENT DOCUMENTS

| | | | | | |
|---|---|---|---|---|---|
| 567,446 | A * | 9/1896 | Baron | B65D 35/42 | 220/322 |
| 615,478 | A * | 12/1898 | Davenport | B65D 25/32 | 220/318 |
| 619,950 | A * | 2/1899 | Fowler | B65D 51/26 | 215/231 |
| 891,921 | A * | 6/1908 | Foster | B65D 45/22 | 215/286 |
| 1,173,305 | A * | 2/1916 | Phelan | B65D 47/0876 | 220/318 |
| 1,663,901 | A * | 3/1928 | Brown | B65F 1/1615 | 217/60 D |
| 2,233,789 | A * | 3/1941 | Lichtenberger | B65F 1/1615 | 220/756 |
| 2,254,141 | A * | 8/1941 | Garcia | A01J 9/00 | 220/262 |
| 2,278,276 | A * | 3/1942 | Maddox | A47J 27/0804 | 220/318 |

(Continued)

*Primary Examiner* — J. Gregory Pickett
*Assistant Examiner* — Gideon Weinerth
(74) *Attorney, Agent, or Firm* — Fleit Gibbons Gutman Bongini Bianco PL; Jose Gutman

(57) ABSTRACT

An improved wet or dry wipe dispenser for one hand use and minimal user dexterity. The dispenser is made up of a carry-handle (106), handle cap (108), lid (102) and bucket (104). The handle cap (108) forms a light contact seal to the lid (102) and retains moisture, but vents excess pressure of volatile liquids. The lid (102) forms a liquid tight seal to bucket (104). The lid (102) is removable allowing replacement of wipe media. An integrated carry-handle (106) and handle cap (108) allows easy portability. The bucket (104) has a liquid level and media window (120) for viewing indication of measurement of wet wipe liquids and for viewing remaining wipe media (702).

13 Claims, 13 Drawing Sheets

(56) References Cited

U.S. PATENT DOCUMENTS 2,501,572 A * 3/1950 Marquez ..... A47J 36/10 16/425
2,627,996 A * 2/1953 Dorner ..... B65F 1/16 220/212.5
3,002,668 A * 10/1961 Castelli ..... A47K 10/20 221/63
3,161,336 A 12/1964 Loescher
3,197,060 A * 7/1965 Farniok ..... B65F 1/1615 220/814
3,236,402 A * 2/1966 Dellinger ..... B65D 25/32 215/286
3,239,097 A 3/1966 Bates et al.
3,266,666 A 8/1966 Nelson
3,349,993 A 10/1967 Ells et al.
3,355,055 A * 11/1967 Abbey ..... B65D 25/32 220/814
3,369,699 A 2/1968 Enloe et al.
3,490,640 A * 1/1970 Martin ..... A47J 36/06 220/744
3,684,086 A 8/1972 Harrison
3,784,055 A 1/1974 Anderson
3,918,608 A 11/1975 Faller
3,979,019 A 9/1976 Bliss
4,143,762 A 3/1979 Spiegelberg
4,156,493 A 5/1979 Julius
4,181,225 A 1/1980 Spiegelberg
4,638,921 A 1/1987 Sigl et al.
4,785,970 A 11/1988 Engelmayer
4,848,575 A 7/1989 Nakamura et al.
4,865,221 A 9/1989 Jackson et al.
4,971,220 A 11/1990 Kaufman et al.
5,050,737 A 9/1991 Joslyn et al.
5,259,550 A 11/1993 Kuchenbecker
5,295,579 A 3/1994 Focke et al.
5,316,177 A 5/1994 Boldt
5,390,820 A 2/1995 Wright et al.
5,415,320 A 5/1995 North et al.
5,467,893 A * 11/1995 Landis, II ..... A47K 10/3818 206/210
D366,830 S 2/1996 Christianson
6,158,614 A * 12/2000 Haines ..... A47K 10/3818 221/33
6,220,435 B1 * 4/2001 Nobile ..... A47K 10/3818 206/210
6,460,727 B1 10/2002 Irwin
6,491,165 B2 12/2002 Kuske et al.
6,499,619 B1 * 12/2002 Snow ..... B44D 3/127 220/315
6,499,626 B1 12/2002 Julius
6,523,690 B1 2/2003 Buck et al.
6,592,004 B2 7/2003 Huang et al.
6,848,594 B2 * 2/2005 Holland ..... A47K 10/3818 206/210
6,959,834 B2 11/2005 McDonald
7,163,124 B2 * 1/2007 Bushman ..... A47K 10/3818 221/135
7,648,046 B2 * 1/2010 Sosalla ..... A47K 10/421 221/150 A
8,584,894 B1 * 11/2013 Mulvaney ..... A47J 36/10 220/318
8,857,614 B2 * 10/2014 Gordon ..... A47K 10/3818 206/233
9,113,759 B2 * 8/2015 Ray ..... A47K 10/3818
2004/0222264 A1 * 11/2004 Tan ..... B26F 3/02 225/106
2008/0083772 A1 * 4/2008 Sellars ..... A47K 10/3818 221/63
2009/0255950 A1 * 10/2009 Simkins ..... A47K 10/3818 221/45
2009/0294322 A1 * 12/2009 Baltz ..... B65D 21/0233 206/519
2012/0018445 A1 * 1/2012 Mendoza ..... A47K 10/3818 221/45
2014/0157995 A1 * 6/2014 Mulvaney ..... A47J 43/0722 99/337
2014/0305958 A1 * 10/2014 Hill ..... A47K 10/426 221/63
2015/0053712 A1 * 2/2015 Laflin ..... A47K 10/3818 221/45

* cited by examiner

WET OR DRY WIPE DISPENSER AND CONTAINER

CROSS-REFERENCE TO RELATED APPLICATION

This application is based upon and claims priority from prior U.S. patent application Ser. No. 29/415,032, filed on Mar. 6, 2012, the disclosure of which is herein incorporated by reference in its entirety.

FIELD OF THE INVENTION

The present disclosure generally relates to wipe dispensers, and more particularly to a refillable wipe dispenser that provides a liquid tight seal and that facilitates use of the wipe dispenser by an individual lacking manual dexterity.

BACKGROUND

Current wipe dispensers plague the consumer with various inconveniences such as: drying of the paper towel, lack of continuous feeding of paper towel, the inability of dispenser reuse, the restriction of use with regard to towel types, and the inability of single-handed use. In this patent application, the paper material used in wipe dispensers shall henceforth be referred to as "media". Originally, wipe dispensers were made to be used once and subsequently discarded. These dispensers commonly used for wiping are designated for either wet or dry use, but not for both wet and dry use. They do not offer the consumer flexibility to create a wet wipe using common household ingredients. Common wipe dispensers do not offer the consumer the option of creating a dry wipe for cleaning purposes. These dispensers also restrict the consumer from using common paper towels for wiping. They typically contain a specifically manufactured towel that fits only into the given dispenser. Wet media containers use media that, over a period of time, will dry and become unusable. Current wipe dispensers often prevent the consumer from using the media in its entirety due to lack of consistent dispensing. Many commonly used dispensers require the use of two hands in order to operate the dispenser. These inconveniences, coupled with the disposable design of common wipe dispensers, necessitate the costly and wasteful purchase of numerous wipe dispensers.

Common wipe dispensers employ a folded, interleaved sheet thus attempting facilitation of pop-up style media feeding. This pop-up style of media which is referenced in patent designator F, S and O has proven to be a flawed method of feeding media. The quality, variability, high production cost and incorrect feeding of the interleaved sheets are problems cited in U.S. Pat. No. 6,460,727 to Irwin, 2002 October. Various attempts have been made to overcome the difficulty that arises when feeding paper media through a dispenser. Over feeding, sheet sticking and tearing are problems that have not been corrected in prior art embodiments.

A limitation is evident when considering U.S. Pat. No. 5,810,200 to Trokhan, 1998 September. Trokhan proposes to correct media feeding with a feature whereby the operator must pull the sheets at a specific angle. This necessitates having the sheets dispensed at only one particular orientation. Examination of U.S. Pat. No. 5,810,200 to Trokhan, 1998 September, reveals only a limited angle of wipe dispensing. Over feeding of media is a common problem with the U.S. Pat. No. 5,810,200 (1998) to Trokhan implementation as attempts are made to engage the feature that should enable sheet separation.

Another solution, proposed in U.S. Pat. No. 5,390,820, to Wright et al. (1995) evidences feeding problems occurring in interleaved wipes. Wright attempts to solve the initial feed problems caused by tight packaging. These difficulties include tearing, loss of pop-up feeding, and media distention back into the container.

The wet wipe rigid containers (prior art cited with patent type designators W and R) have a limitation whereby the amount of media available for wiping must not exceed the length of the sheet contained therein. The sheet length enables the interleaved wipe to reach the top of the container. Such a design causes sheet separation inside the container. The U.S. Pat. No. 6,460,727 to Irwin, October 2002, attempts to address this functional difficulty by keeping the media at a constant elevation. This Irwin patent fails in its attempts to avoid over-pressing the media, inducing tearing of the media, and limiting the media cache.

Nearly all pop-up containers require a friction lid feed opening to separate the wipes and hold the subsequent wipe. The U.S. Pat. No. 6,158,614 to Haines et al. (2002) is a typical example of high friction dispensers. High separation force is needed to enable media feeding in these dispenser implementations. Such containers have drawbacks including inconsistency in media manufacture, and an inability to provide continuous feeding of media. Bothersome premature separation occurs while causing loss of media feeding.

This limitation does not allow the user to pull multiple wipes, which remain joined to form a larger wipe.

Currently most wipe containers require the use of two hands. These embodiments are indicated by patent designator 2H. An additional encumbrance to individuals lacking manual dexterity is that most wipe dispensers become very light weight as the media is consumed. This results in a loss of upright stability. Disposable containers (patent designator S) and disposable reusable rigid (patent designator R) containers, all lack sufficient mass needed to maintain stability. The force needed to separate and dispense a wipe exceeds the stability of the container. Single-handed operation, as noted in patent designator 1H, becomes almost impossible as the inventory of wipes decreases within the container.

A consistent problem noted in current wipe containers is drying of media. Media drying is caused by at least two endemic design flaws. One such flaw is the lack of a liquid tight seal as in U.S. Pat. No. 4,156,493 to Julius, 1979 May. Another such flaw is a liquid tight cap that will open upon being subjected to heat. This subsequent opening causes the internal media to become dry. A conical lid opening of U.S. Pat. No. 5,560,514 (1996) to Frazier, causes media drying due to high friction squeezing of the media.

Most wipe containers heretofore known suffer from a myriad of disadvantages including but not limited to the following:

(a) The use of specifically designed media restricts the ability of the media to be composted after use.

(b) Wipe containers currently lack ruggedness.

(c) Current designs restrict the use of a commonly available media.

(d) The wipe containers in present use are not designed to be used by an individual lacking manual dexterity.

(e) Present wipe containers having high-friction, conical lid feed openings, may cause a user to be injured while trying to retrieve, or start feeding the wipe media.

(f) The inability to use a homemade formula for wipe saturation, within most wipe containers, poses a hindrance to individuals with medical sensitivities.

(g) Dispensers currently available are typically restricted to use with only the media contained therein and therefore cannot be refilled.

(h) Viewing of available media and measuring of fluid for wipe saturation are both features which are lacking in current embodiments.

SUMMARY OF THE INVENTION

In accordance with one embodiment a wipe dispenser container comprises several aspects including but not limited to a cylindrical bucket, a lid, and a handle.

There are several advantageous aspects. The dispenser facilitates a nearly infinite variety of both wet and dry wipes. The media used in the dispenser may be selected from a wide variety of commercial products. Individuals lacking manual dexterity have a solution for wiping needs. The dispenser can be used without concern that the media will dry and become unusable. One advantageous aspect is the durability of the wipe container in a variety of environments. An additional advantageous aspect is the saturation of the wipe with solutions efficacious for various individuals with special needs. Another advantageous aspect allows the use of the wipe container with only one hand. Consequently, the aforesaid advantageous aspects of the container provide numerous cost effective applications in a wide variety of environments. These and other advantages will become apparent when the descriptive drawings and accompanying specification are considered.

According to one embodiment, portable wet or dry media dispenser for wipes comprises: a bucket to contain the media, and saturating solution if used wet; a lid for the bucket, the lid having an opening for dispensing wipes through the lid opening, the lid additionally forms a liquid tight seal to the bucket; and a rotatable handle cap for the lid that is rotated to cover the opening in the lid, in a closed position, and the handle cap is rotated to uncover the opening, in an open position, the rotatable handle cap is mechanically coupled with a carry-handle, the carry-handle for carrying the dispenser by the carry-handle in the closed position of the handle cap, and where the dispenser through the opening presents pop-up continuous feed wipes to a user of the dispenser as the user selects and pulls one or more media wipes from the inside of the bucket through the opening, the one or more media wipes provided in solution as saturated wet wipes form or as dry wipes form.

According to another embodiment, a portable media dispenser for wet wipes comprises: a bucket to contain the media and saturating wet solution; a lid for the bucket, the lid having an opening for dispensing wet wipes through the lid opening, the lid additionally forms a liquid tight seal to the bucket; and a rotatable handle cap for the lid that is rotated to cover the opening in the lid, in a closed position, and the handle cap is rotated to uncover the opening, in an open position, the rotatable handle cap is integrally formed with a handle in a single rotatable unit, and where the dispenser through the opening presents wipes to a user of the dispenser as the user selects and pulls one or more media wipes from the inside of the bucket through the opening, the one or more media wipes provided in solution as saturated wet wipes form.

According to another embodiment, portable media dispenser for dry wipes comprises: a bucket to contain the wipe media; a lid for the bucket, the lid having an opening for dispensing wipes through the lid opening, the lid additionally forms a liquid tight seal to the bucket; and a rotatable handle cap for the lid that is rotated to cover the opening in the lid, in a closed position, and the handle cap is rotated to uncover the opening, in an open position, the rotatable handle cap is integrally formed with a handle in a single rotatable unit, and where the dispenser through the opening presents wipes to a user of the dispenser as the user selects and pulls one or more media wipes from the inside of the bucket through the opening, the one or more media wipes provided in dry wipes form.

BRIEF DESCRIPTION OF THE DRAWINGS

The accompanying figures in which like reference numerals refer to identical or functionally similar elements throughout the separate views, and which together with the detailed description below are incorporated in and form part of the specification, serve to further illustrate various embodiments and to explain various principles and advantages all in accordance with the present disclosure, in which.

DETAILED DESCRIPTION

As required, detailed embodiments are disclosed herein; however, it is to be understood that the disclosed embodiments are merely examples and that the devices, systems and methods described herein can be embodied in various forms. Therefore, specific structural and functional details disclosed herein are not to be interpreted as limiting, but merely as a basis for the claims and as a representative basis for teaching one of ordinary skill in the art to variously employ the disclosed subject matter in virtually any appropriately detailed structure and function. Further, the terms and phrases used herein are not intended to be limiting, but rather, to provide an understandable description. Additionally, unless otherwise specifically expressed or clearly understood from the context of use, a term as used herein describes the singular or the plural of that term.

The terms "a" or "an", as used herein, are defined as one or more than one. The term "plurality", as used herein, is defined as two or more than two. The term "another", as used herein, is defined as at least a second or more. The terms "including" and "having," as used herein, are defined as comprising (i.e., open language). The term "coupled," as used herein, is defined as "connected," although not necessarily directly, and not necessarily mechanically. "Communicatively coupled" refers to coupling of components such that these components are able to communicate with one another through, for example, mechanical, wired, wireless or other communications media. The term "configured to" describes mechanical structure, hardware, software, or a combination of hardware and software, that is adapted to, set up, arranged, commanded, altered, modified, built, composed, constructed, designed, or that has any combination of these characteristics to carry out a given function. The term "adapted to" describes mechanical structure, hardware, software or a combination of hardware and software, that is capable of, able to accommodate, to make, or that is suitable to carry out a given function.

Referring to the figures, an example of a wipe dispenser container 100 is shown according to the present disclosure.

Figure 1:
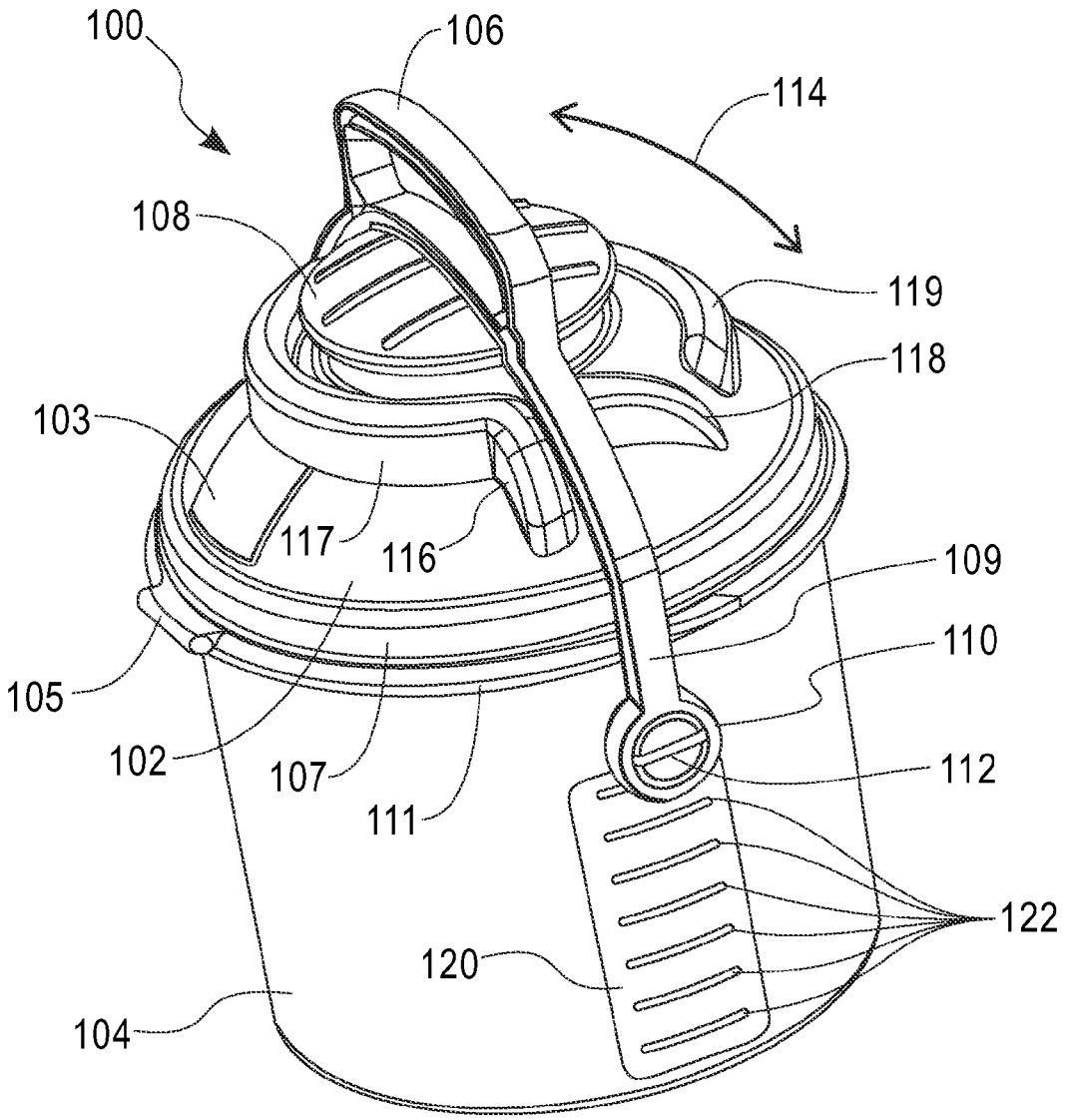
FIG. 1 is a perspective view of an example of a fully assembled dispenser and container.

The dispenser 100, according to the example, is composed of three components: carry-handle 106, lid 108, and bucket 104. FIG. 1, for example, shows a perspective view of the three components, i.e., the carry-handle, lid, and bucket.

The carry-handle 106 forms an opening 202 that facilitates (e.g., the fingers 1104 of) a user of the dispenser container 100 holding (e.g., grasping) the carry-handle 106 to carry the container 100 while the carry-handle 106 is locked in a closed position, as will be discussed below. The carry-handle 106 is mechanically coupled to a handle cap 108 as shown in the various figures. A lid feed opening 904 in the lid 102 can be selectively covered or uncovered by the handle cap 108 to close or open the lid feed opening 904, as will be discussed below.

Figure 2:
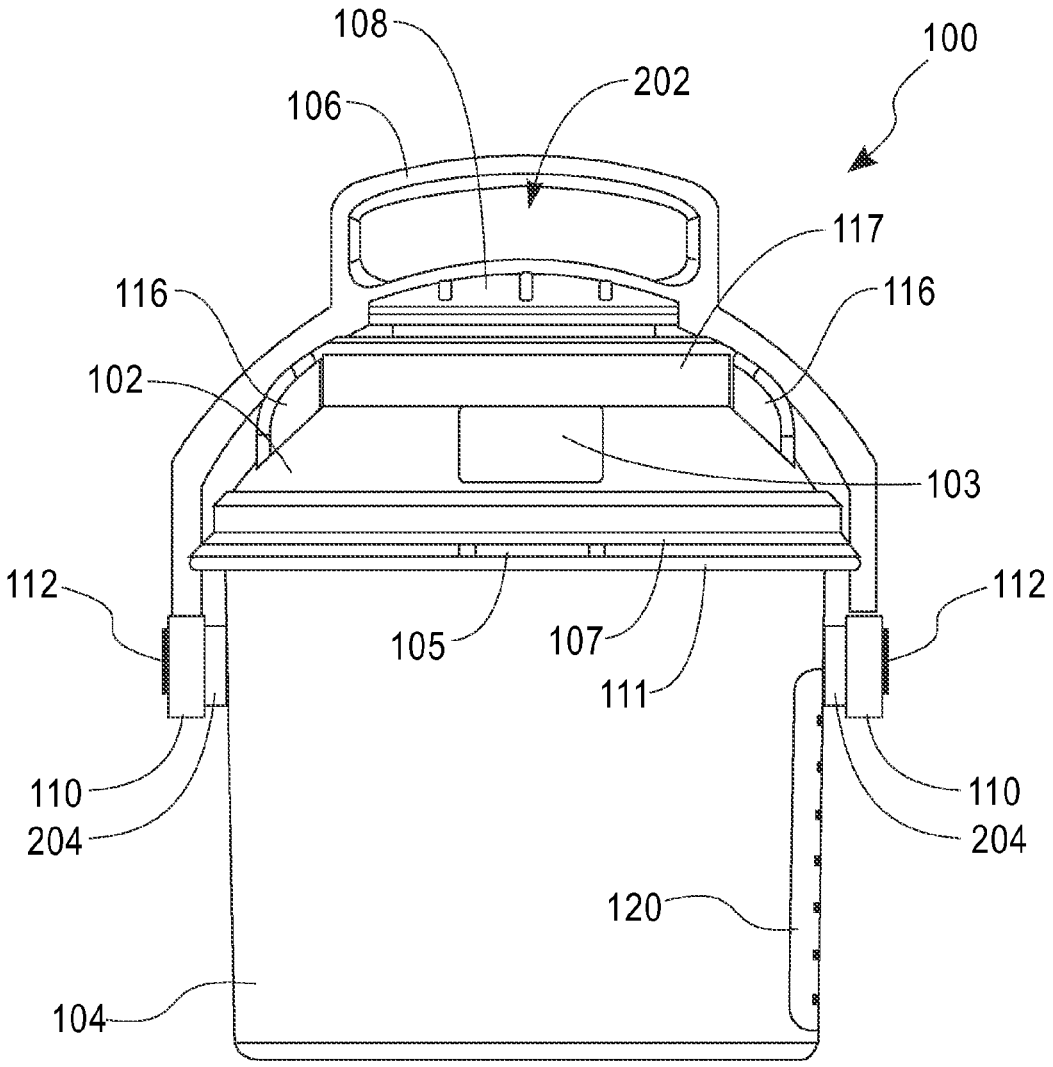
FIG. 2 is a front view thereof.
Figure 6:
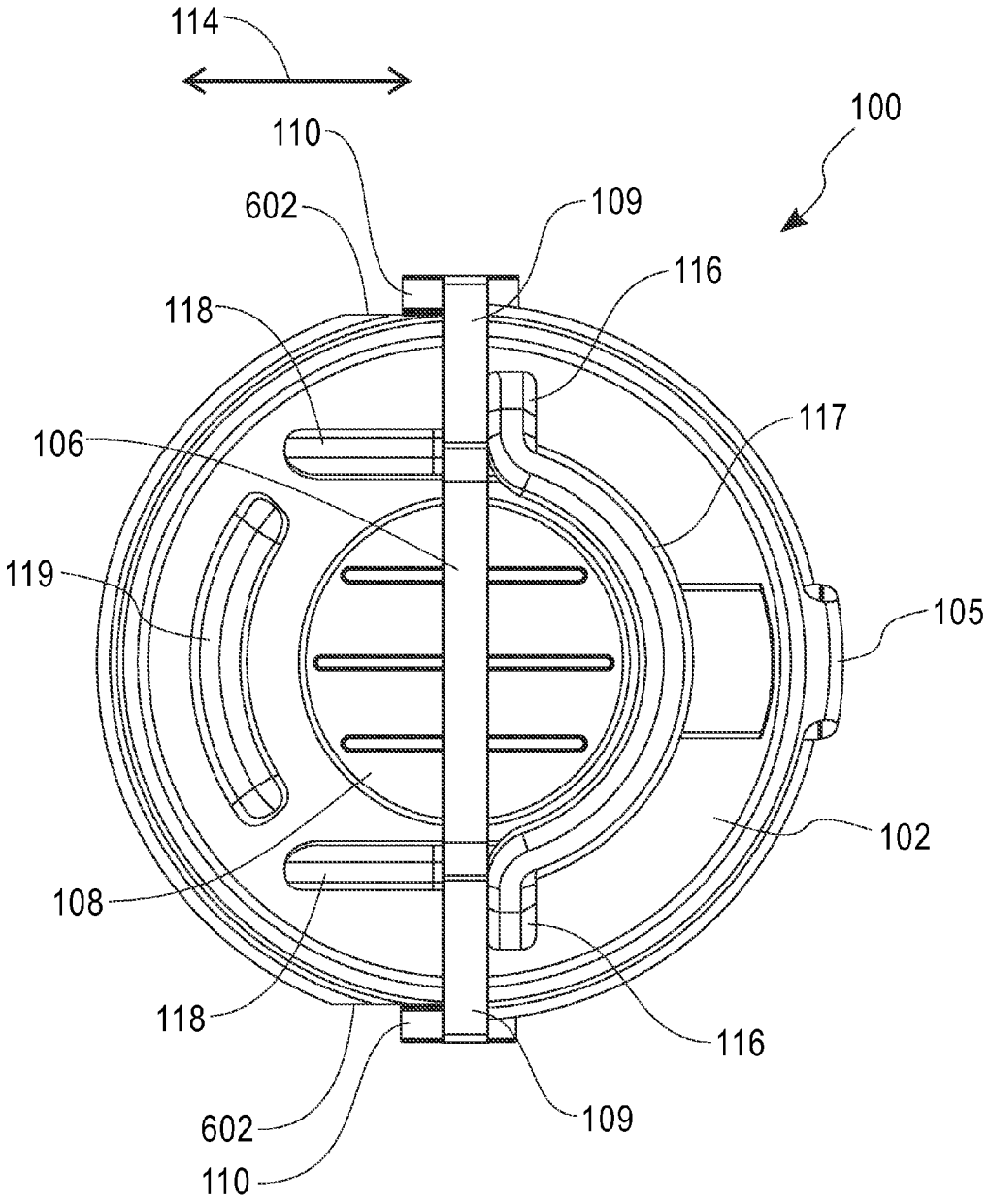
FIG. 6 is a top view thereof.
Figure 7:
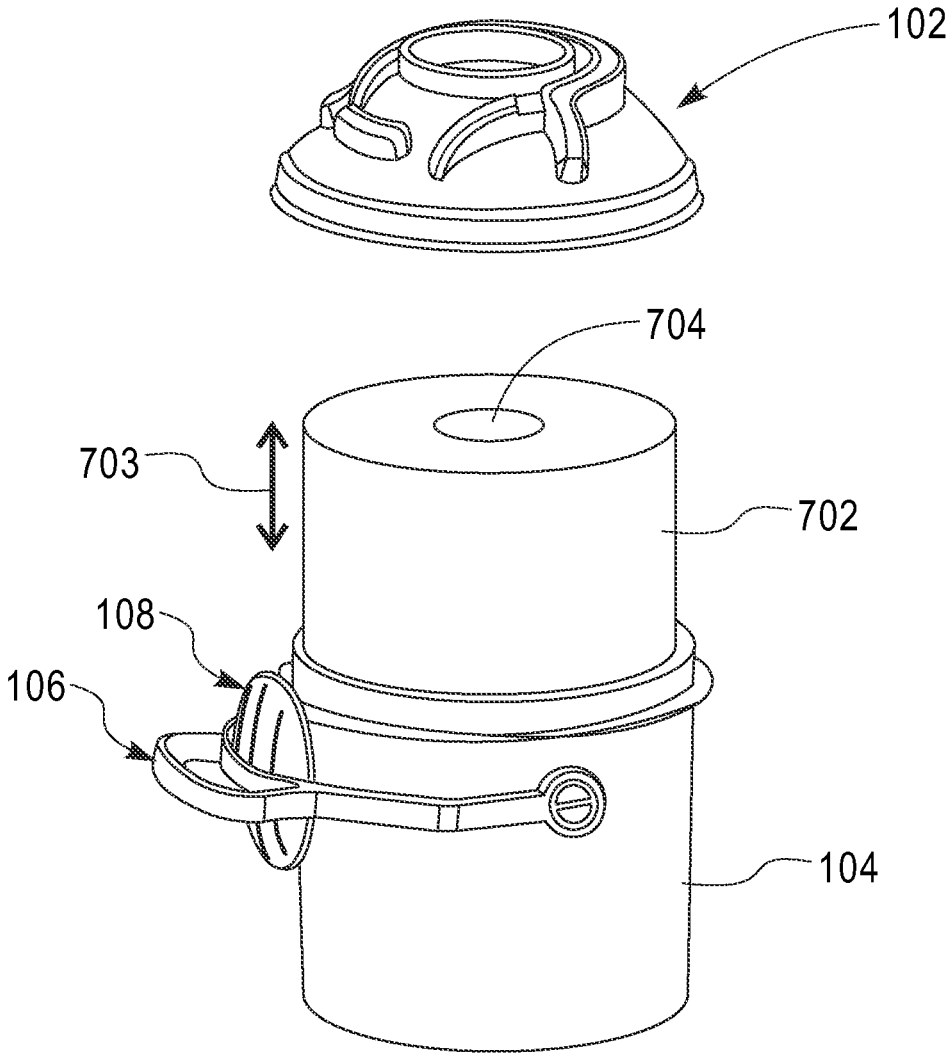
FIG. 7 is a view of the example dispenser container including a lid, bucket, handle and cap, and showing an example wipe media that can be loaded in the dispenser container, according to the present disclosure.
Figure 8:
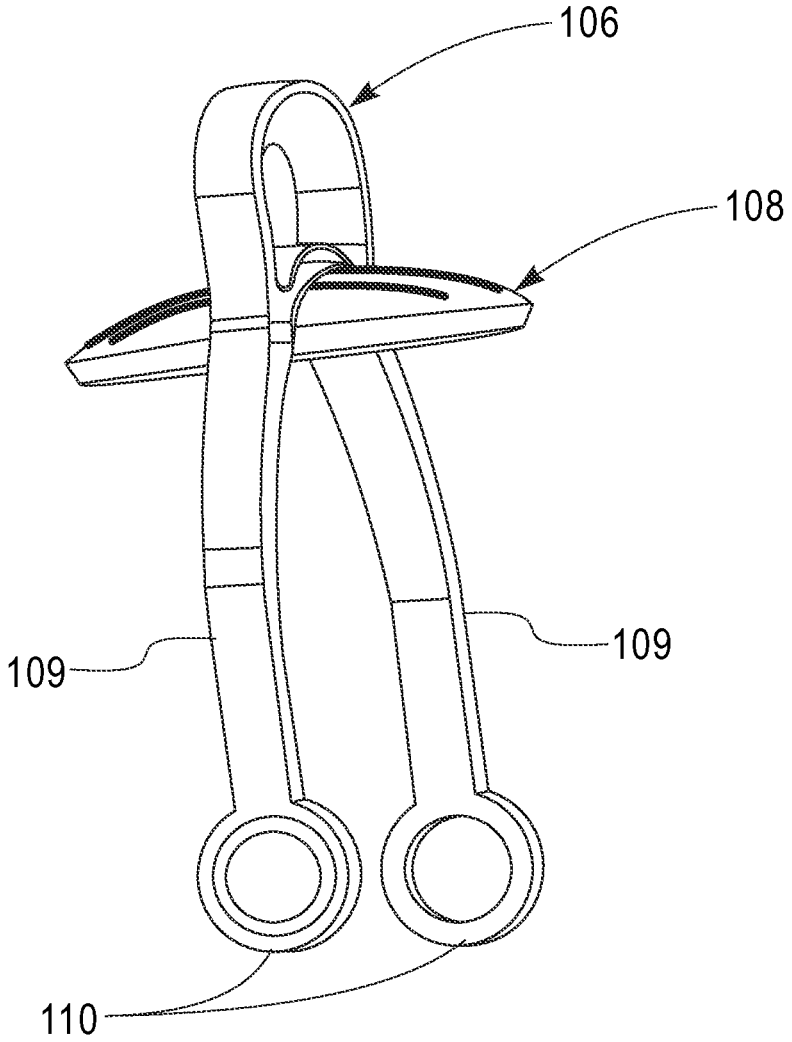
FIG. 8 is a side view of the handle and cap used in the dispenser container, according to the example.
Figure 9:
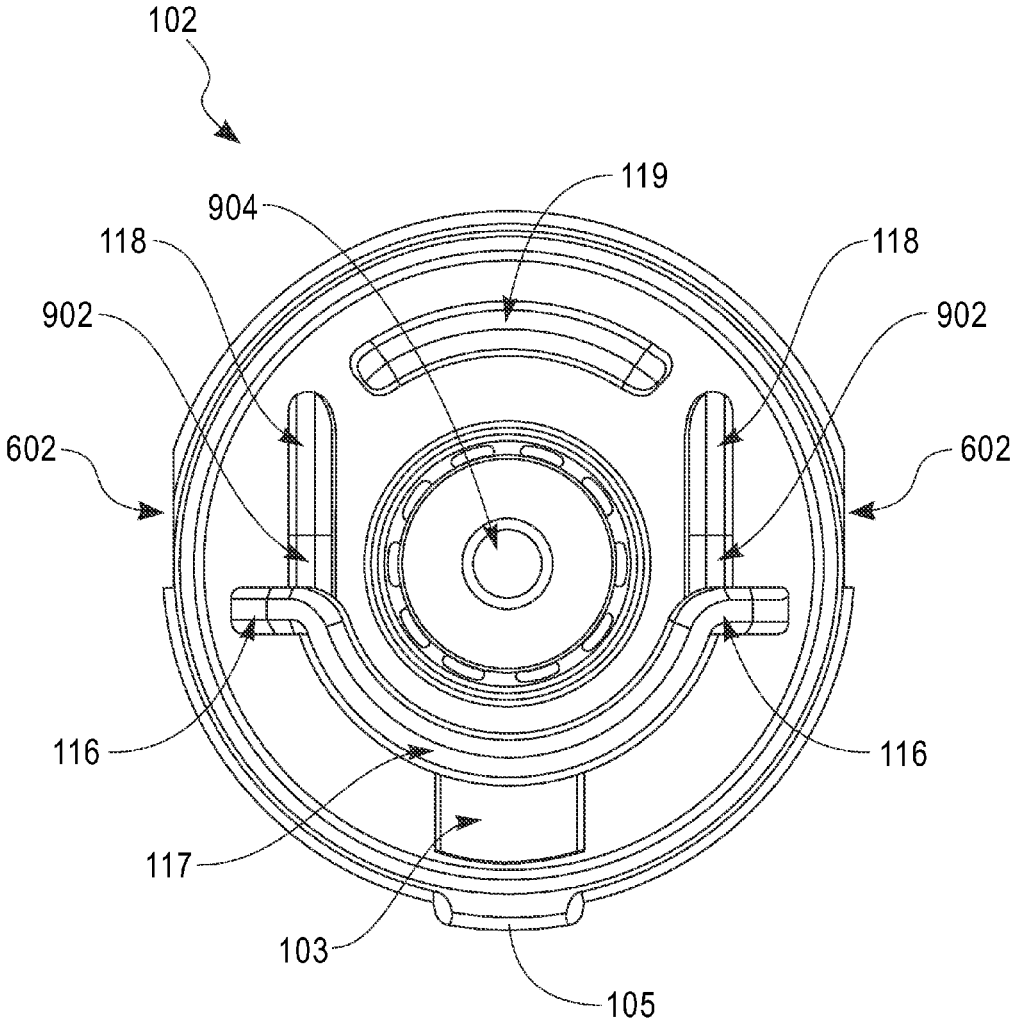
FIG. 9 is a top view of the lid, according to the example.
Figure 10:
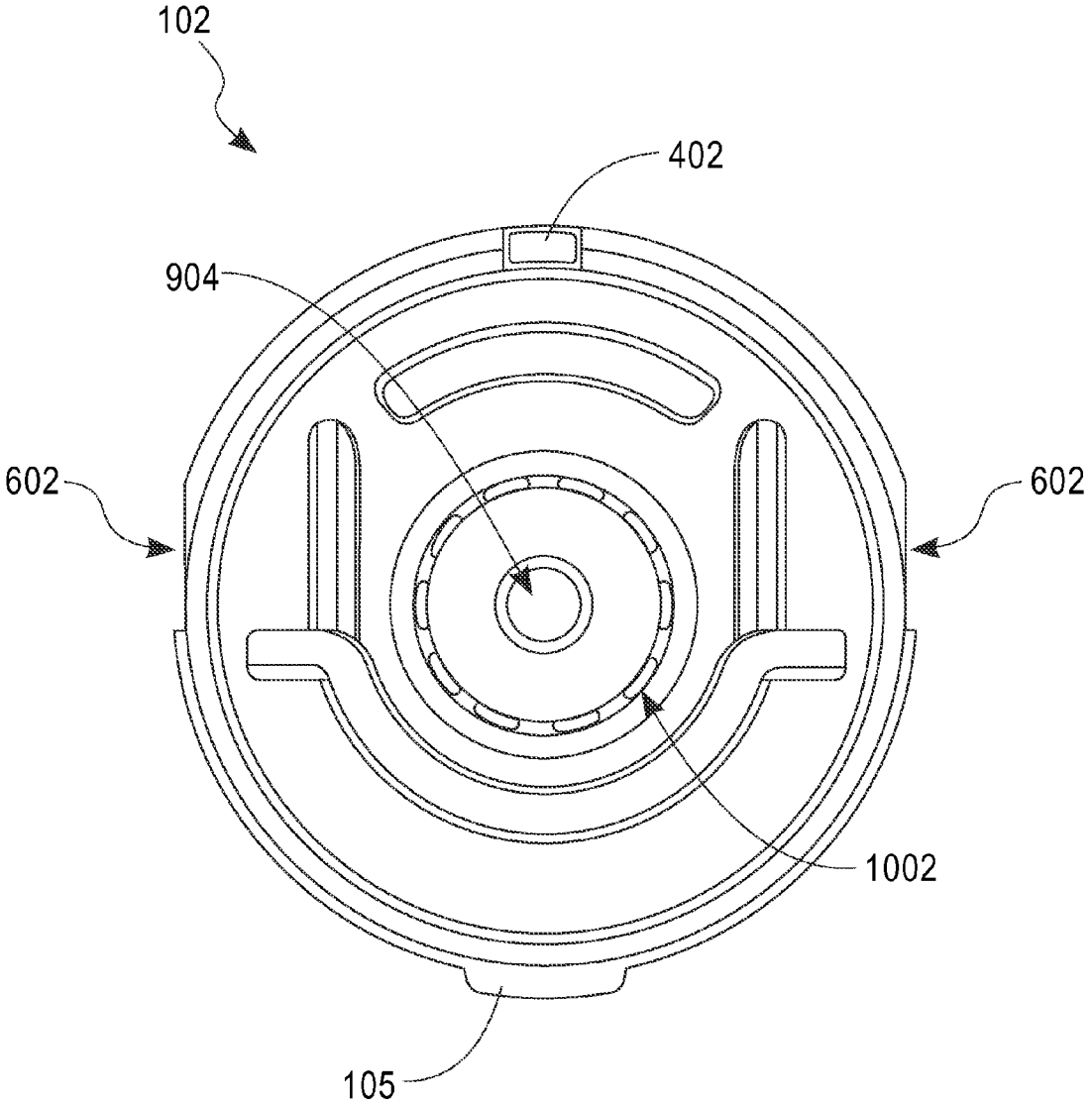
FIG. 10 is a view of the underside of the lid, according to the example.

The handle cap 108 and carry-handle 106, according to various embodiments, are integrally combined into a single rotatable unit. The carry-handle 106 rotatably attaches to the bucket 104 by a pair of arms 109 each having a handle pivot eye 110 for attaching to a respective handle post 112 on the side of the bucket 104. Each handle pivot eye 110 is pressed onto and surrounding the handle post snap attachment head 112 and resting against a slightly larger diameter shoulder 204 of the handle post. See FIG. 2. The handle post snap attachment heads 112, located on each side of the bucket 104, are tapered to allow the handle pivot eye 110 of each handle arm 109 to be pressed onto the bucket 104. Light deformation of the handle post snap attachment head 112 facilitates compression onto the handle pivot eyes 110 and a firm snap to the bucket 104. Once pressed onto the handle snap attachment post 112, the carry-handle 106 freely rotates over the handle snap attachment post head 112. The carry-handle 106 is mechanically coupled to a handle cover 108 that serves as the cover for the lid feed opening 904 of the lid 102. In the present example, the handle cap 108 and the carry-handle 106 are integrally combined into a single rotatable unit, as shown in FIG. 8. In various embodiments, the handle cap 108 can be a separate part from the carry-handle 106. The handle cap 108 includes a plurality of reinforcement ribs, as shown in FIG. 6. The lid feed opening 904 is covered by the handle cap 108 when the carry-handle 106 is rotated 114 to the closed position as shown in FIG. 1.

The handle cap 108, according to various embodiments, is maintained in the closed position covering the lid feed opening 904 under tension via pressure exerted by the pair of arms 109 each having a handle pivot eye 110 attached to a handle post 112 in the bucket 104 that pulls down the arm 109 toward the handle post 112. In this way, a non-liquid tight seal is made by the handle cap 108 to the lid 102 while covering the lid feed opening 904, so that gas can escape from the lid feed opening 904 to vent gas pressure from inside the bucket 104 while preserving a liquid tight seal between the lid 102 and the bucket 104. The liquid tight seal between the lid 102 and the bucket 104 prevents gas pressure from forcing liquid through the liquid tight seal.

Figure 3:
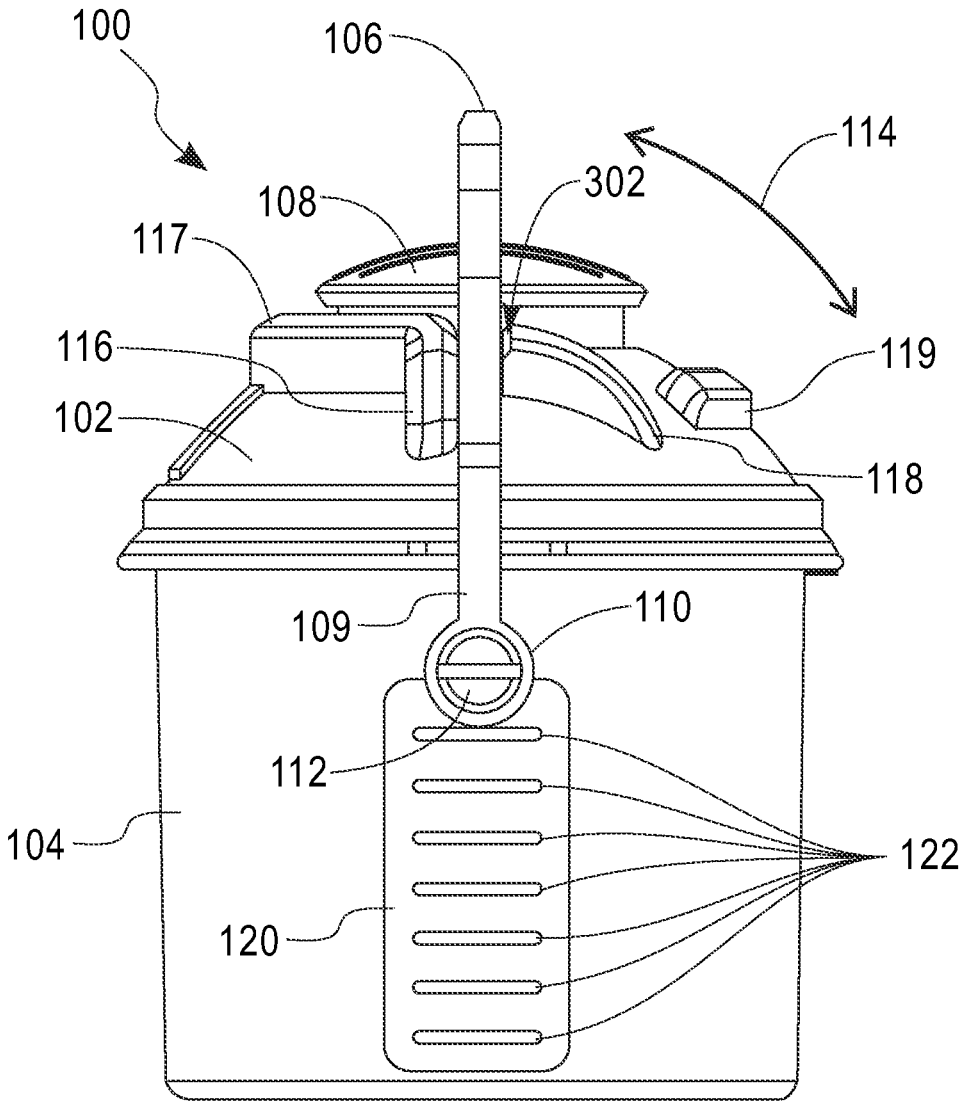
FIG. 3 is a right side view thereof.

The lid 102 has a lid handle open feature 119 and lid handle close feature 117 to provide reference features and leverage points for a user's hand 1102 to locate on the lid 102 (such as for locating the thumb 1106 or the butt of the palm of the hand 1102) for opening 1108 (see FIG. 11) and closing (see FIG. 12) the container 100. The other fingers 1104 grasp the carry-handle 106 such as via the opening 202. The lid 102 has a pair of handle ramps 118 which lift the handle (e.g., the handle arms 109) over the ramps 118 as the handle cap 108 rotates 1108 from a closed position to an open position, and vice versa. This will prevent degradation of the handle cap 108 material that would happen when opening 1108, closing, or locking the carry-handle 106 and handle cap 108 into the closed position. See FIGS. 3 and 12 which show the lid handle lock recess 302 that retains the arm 109 and the carry-handle 106 and handle cap 108 in the closed ("locked") position until sufficient opening rotational force is applied to rotate 114 the carry-handle 106. The handle backstop 116 prevents the carry-handle 106 and handle cap 108 from being rotated 114 too far as it is moved to the closed position. The handle backstop 116 prevents rotating the handle cap 108 past the locked closed position.

The lid opening tap 105 is used for leverage by a user to more easily remove the lid 102 from, or attach the lid 102 to, the bucket 104. The center of the lid 102, according to the present example, contains the lid feed opening 904 which facilitates wipe media 702, 1204 passage 1302 through the lid feed opening 904 from the interior of the bucket 104 to the outside of the dispenser 100. A logo panel 103 is provided to mark the dispenser 100 or means of advertisement and branding. The logo panel 103 can be changed as an inset to the mold without having to change the mold used to make the lid 102, according to various embodiments. Liquid drain back openings 1002 are provided next to the toothed ring 1202 to allow excess moisture on a wipe to return to the bucket 104. The toothed ring facilitates at least one of separating perforated wipe media 1204 pulled from the dispenser 100, and cutting continuous wipe media 1204 pulled from the dispenser 100. The lid key feature 402 fits (mates) into the bucket (mating) key slot 404 to provide correct orientation, alignment, and location of the lid 102 relative to the bucket 104 when the lid 102 is snapped onto the bucket 104 for closure. The handle swing cut out 602 on the lid 102 (and a similar handle swing cut out in the side of the bucket 104) allows the carry-handle 106 (and arms 109), when removed from the locked closed position, to rotatably swing 114 freely between opened and closed positions.

The bucket 104 has a plurality of base concentric rings (not shown) from the center to the outer perimeter of the bottom of the bucket 104 to allow the bucket bottom to have abrasion resistance and sit flat on uneven surfaces without rocking. The bucket 104 has a pair of handle posts 112 to attach the carry-handle 106 and handle cap 108 to the bucket 104. The handle post snap head 112 allows the carry-handle pivot eye 110 to snap onto the handle post 112 for retention. The bucket 104 has a lid key slot 404 used for orientation when the lid 102 and bucket 104 are joined. A liquid level and media window 120 is provided as a transparent window on the side of the bucket 104 to provide a visual indication measure of liquid levels and of the remaining volume of wipe media in the bucket 104 of the container 100. The liquid level indicator lines 122 are marked in the liquid level and media window 120 to measure liquid level inside the bucket 104, as well as to indicate the remaining wipe media volume in the bucket 104.

A first perimeter about the top of the bucket 104 includes a snap seal back cut flare that is used to press the lid 102 to the bucket 104. The snap seal grab extension 111 can be used to help join and separate the bucket 104 from the lid 102. An outer perimeter region 107 of the lid 102 can rest on the snap seal grab extension 111 that, according to various embodiments, in combination of the snap seal back cut flare pressing against the lid 102 helps form a liquid tight seal between the lid 102 and the bucket 104. A handle swing cut out 602 in the side of the bucket 104 matches a similar handle swing cut out on the side of the lid 102 to allow the arm 109 of the carry-handle 106 to swing open and closed as the arm 109 of the carry-handle 106, via the carry-handle pivot eye 110, rotates 114 about the handle post 112.

Operation

The manner of using the dispenser 100 to create a wipe 1204 is unlike that employed by current wipe dispensers. Namely, one first cuts a paper towel roll in half. Next, the desired liquid is dispensed into the bucket 104 with the aid of the media window 120 and the indication lines 122. Insertion 703 of the wipe media 702 follows.

Figure 4:
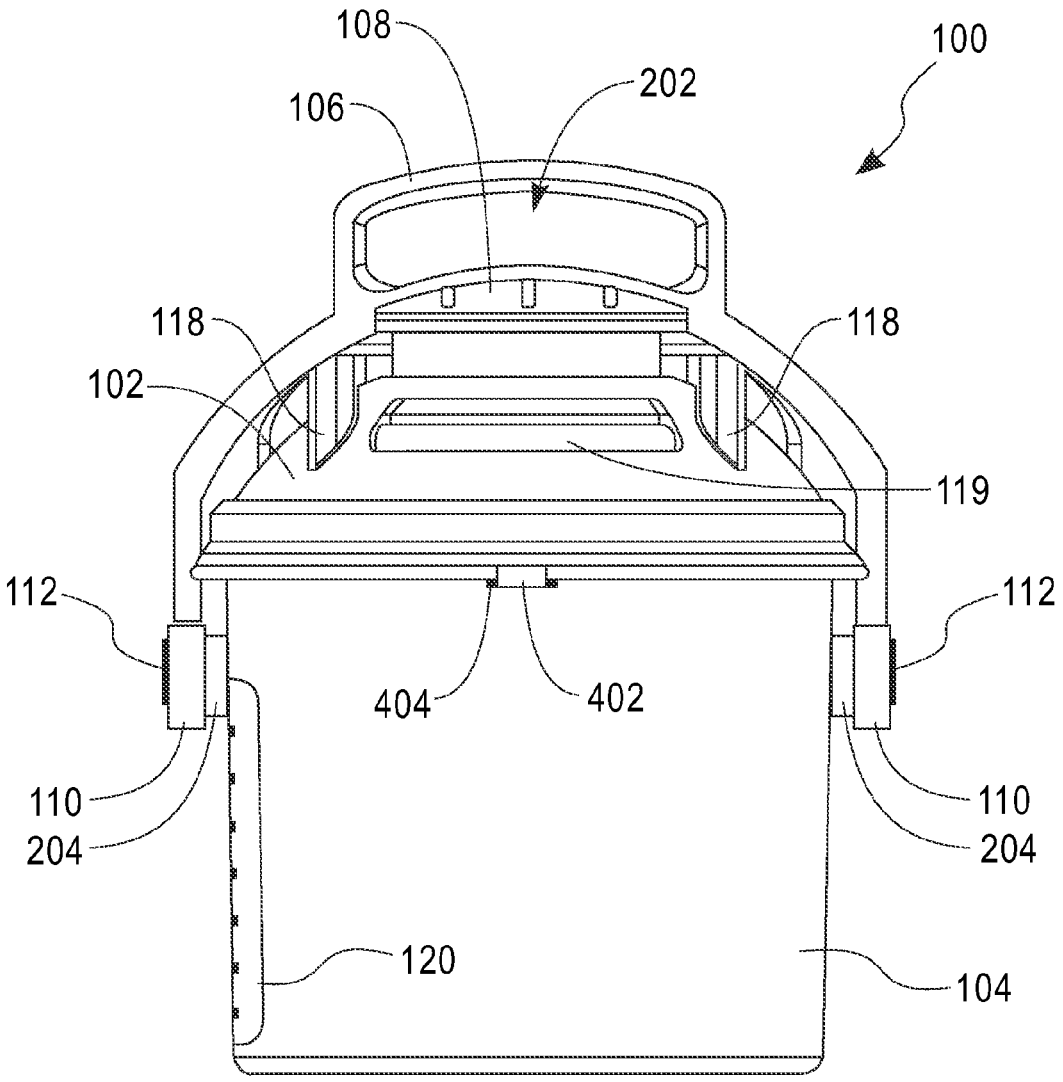
FIG. 4 is a rear side view thereof.
Figure 5:
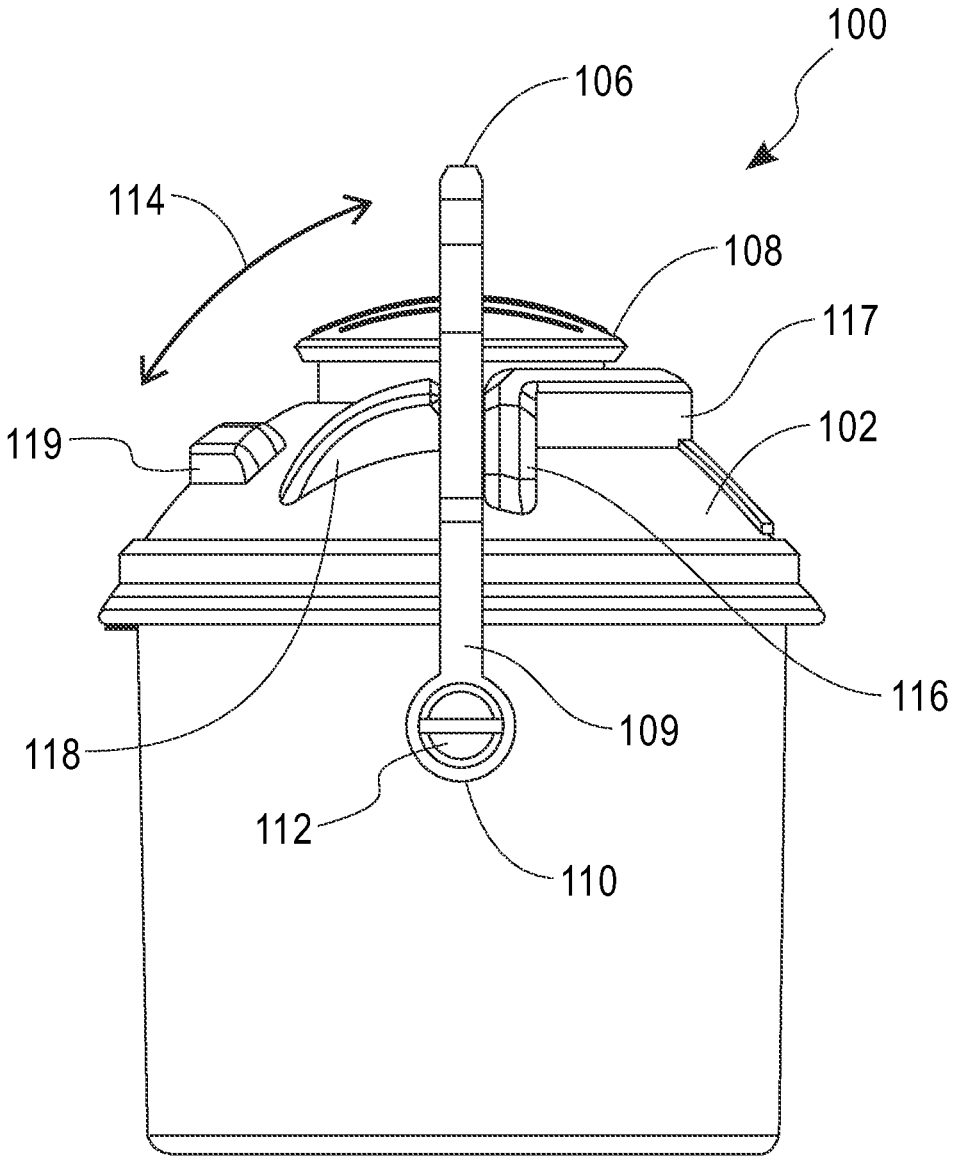
FIG. 5 is a right side view thereof.

Once the wipe media is saturated, an inner cardboard roll (not shown) is removed from the wipe media 702 leaving a center opening 704 in the wipe media 702. Center pulling of the wipe media 702 can commence (see FIG. 13). Then one pulls the wipe media 1204 through the lid 102. Snapping the lid 102 onto the bucket 104 follows, facilitated by the lid key 402 and mating slot 404 (see FIG. 4). The wipe dispenser 100 is now ready for use. Notably, the conical space around the tooth rings 1202 allows for storage of the wipe 1204 (see FIG. 12) when the handle cover 108 is moved into the locked closed position creating a seal with the lid 102. This seal, according to various embodiments, can be a non-liquid tight seal made by the handle cap 108 pressed onto the lid 102 while covering the lid feed opening 904. In this closed position, gas can escape from the lid feed opening 904 to vent gas pressure from inside the bucket 104 while preserving a liquid tight seal between the lid 102 and the bucket 104. The liquid tight seal between the lid 102 and the bucket 104 prevents gas pressure from forcing liquid through the liquid tight seal.

Advantages

From the description above, a number of advantages of some embodiments of this wet or dry wipe dispenser and container 100 become evident:

A versatile aspect of the design allows users to avail themselves of commercially available wipe media 702, 1204.

The user can select increments of single wipe lengths at perforated intervals, multiples of perforated intervals, or a less than perforated interval length with the toothed ring 1202 cutting feature on top of the lid 102 and lid feed opening 904 of the dispenser 100.

The sawtooth cutting feature 1202 allows the use of media that is or is not perforated.

Near liquid tight design prevents wet wipes from drying out in both hot and/or dry climates. This is true even for long durations of storage.

The container is designed to minimize leakage when tipped or inverted. Consequently, the container is appropriate for rugged environments.

Figure 11:
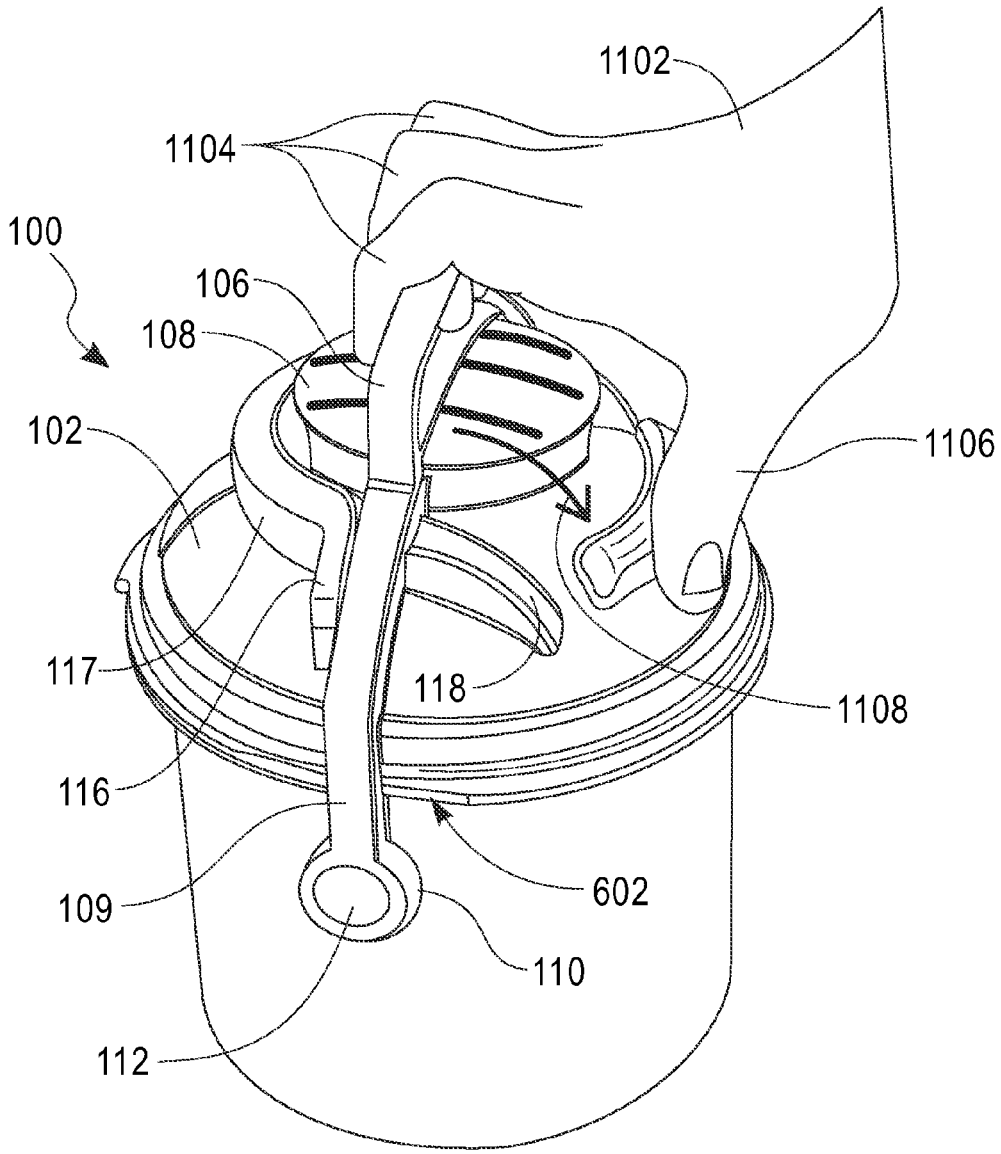
FIG. 11 is a view of the example dispenser container being opened in a one handed operation.
Figure 12:
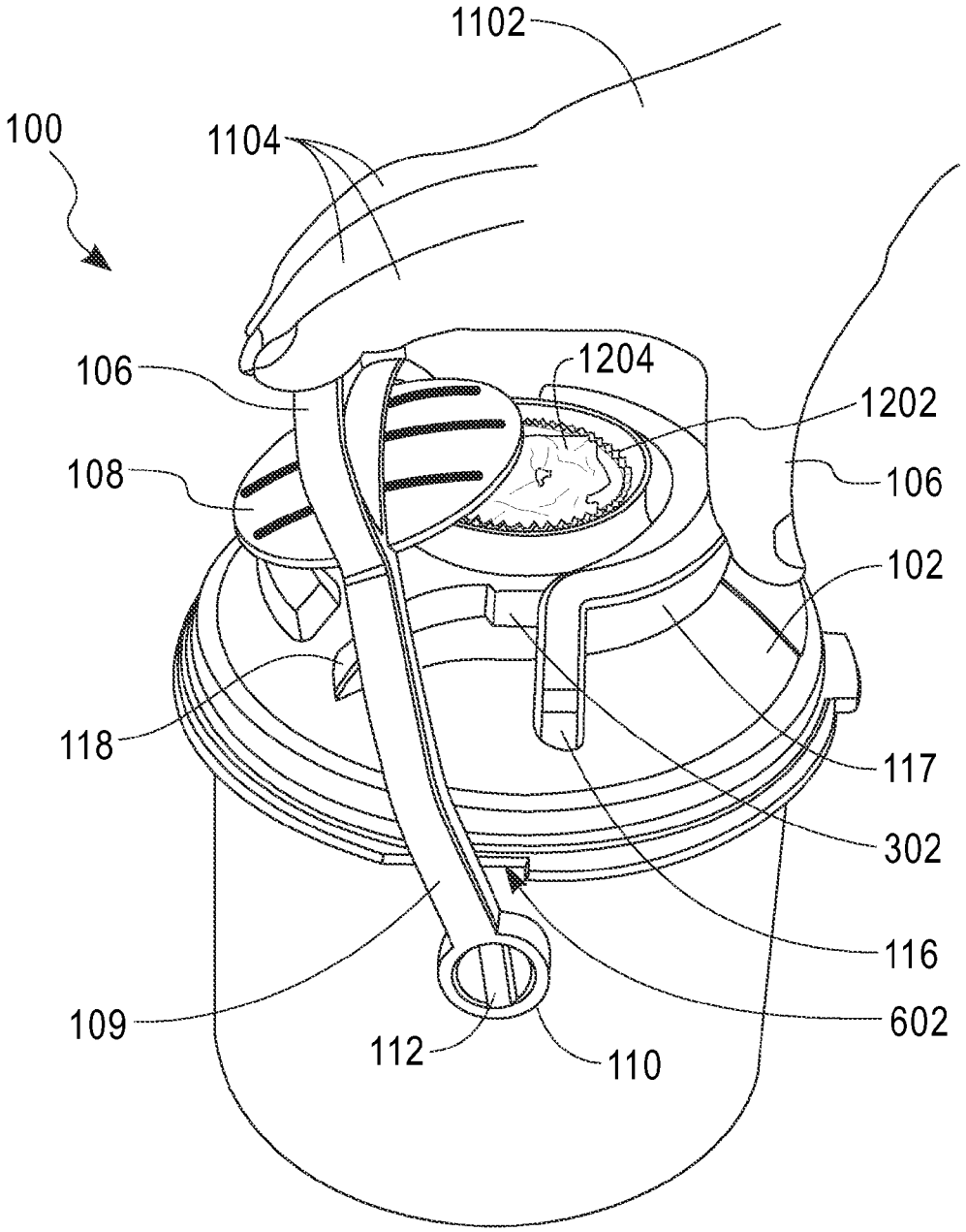
FIG. 12 is a view of the example dispenser container being closed in a one handed operation.
Figure 13:
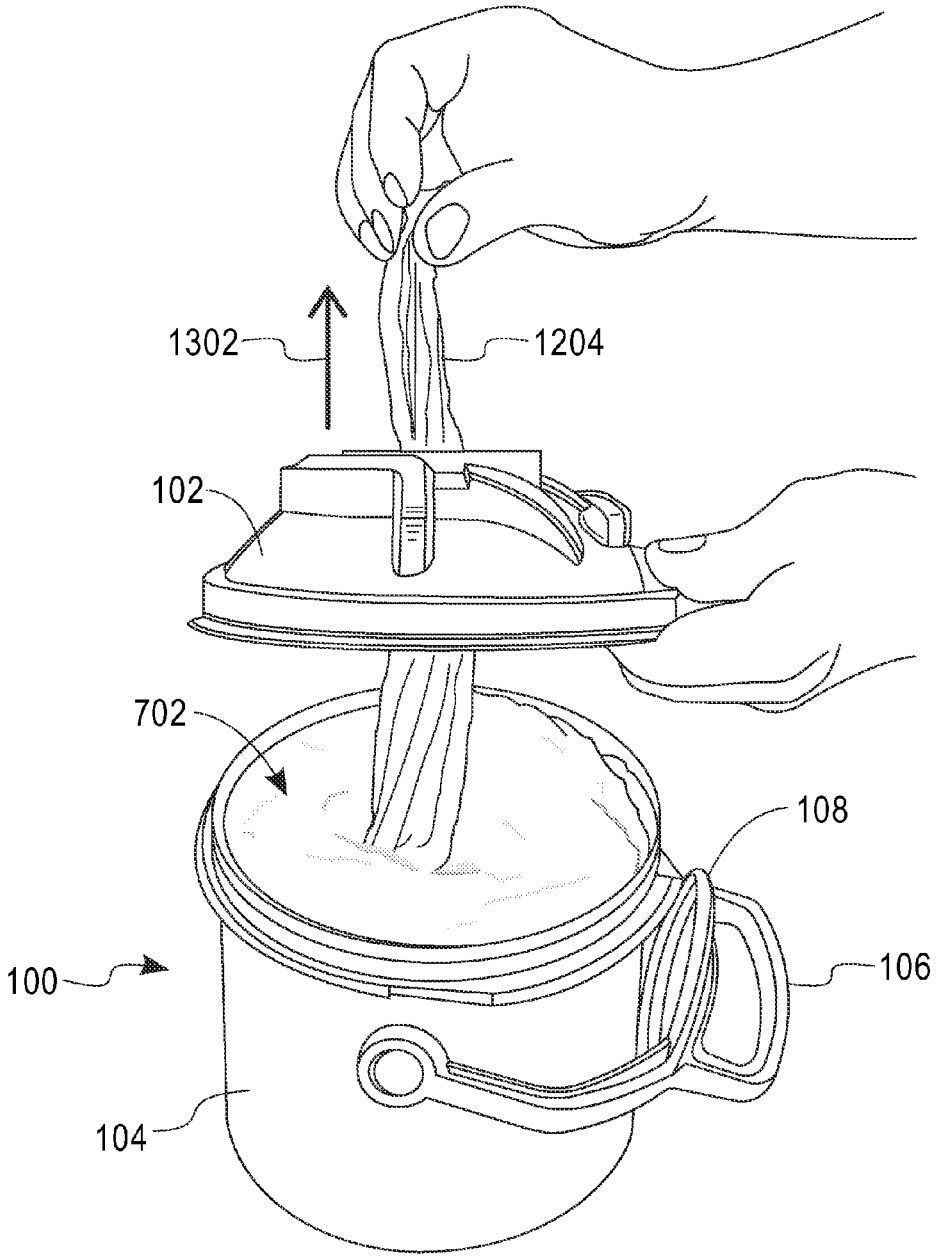
FIG. 13 is a view of the example dispenser container with wipe media being threaded through the lid, according to the present disclosure.

An additional advantage provided by an aspect of the design is the single-handed operation, such as shown in FIGS. 11 and 12. FIG. 11 shows a single handed opening of the handle cover 108 from the lid 102. FIG. 12 shows a single handed closing of the handle cover 108 onto the lid 102. Additionally, the thumb is not required for wipe dispensing, opening, or closing the dispenser. Alternatively, as an example, the butt of the palm of the hand may be used along with the other fingers 1104 to open or close the dispenser 100.

A concave, oversized dispensing opening is a unique aspect of the container which provides storage under the handle cap 108 when in the closed position covering the lid feed opening 904. When an excessive number of wipes are dispensed, this storage area keeps them moist.

The aspect of an integral carry-handle 106 and handle cap 108 facilitates portability with full or minimal hand dexterity.

An array of fluid mixtures can be used to saturate the wipe media 702. This aspect of the design provides a wipe that can be used by individuals with varying allergies.

A unique aspect of the design facilitates container reuse. When depleted, the wipe container can be refilled thereby making it available for a different mixture.

A transparent window 120 on the container 100 with graduated marks 122 serves a dual purpose: to indicate a measure of liquid when creating wet wipes and to indicate the volume of wipes remaining in the dispenser bucket 104 whether they are wet or dry.

The cost advantage of using off the shelf media for the dispenser 100 allows the user to select any size or quality of media to create a custom solution and to enjoy the low cost benefit of high volume, readily available media 702.

The dispenser 100 can be set with an interchangeable logo field 103 to allow for private branding. Consequently, the container 100 does not rely on labels for branding that will be destroyed in the washing and reuse of the dispenser.

Conveniently, commercial wipe heaters may be used since the bucket has been designed for appropriate fit. Additionally, the bucket can accommodate a surrounding storage apron for a variety of applications.

Either wet or dry wipes may be dispensed from the container 100.

The container 100 is significantly more rugged than a disposable container. This ruggedness protects the wipe media 702 should the container be crushed or dropped.

When in the closed position, the container handle acts as a protection device to retain the lid attached to the bucket. If the container is subjected to distress, the contents are protected from being spilled or damaged.

The easy locking handle 106 swings into position with the lid backstop feature 116. This aspect facilitates single-handed closure.

An additional design aspect is the tooth ring found on the inside of the dispenser opening. Difficult to separate media, when pulled from any direction, easily come apart with this design aspect.

Some media is more difficult to separate if not perforated or not well perforated. This tooth ring allows the user to pull the media across the teeth to separate difficult media or to cut the media if not perforated. This ring of teeth applies a small drag on the media being pulled to help in separation and in retaining the next wipe to be used.

The design of the tooth ring described above allows for an innovative conservation of media. The design allows for moisture to slip back into the bucket, thus maintaining the supply of media solutions intact.

The design features alignment keys that prevent the lid from being improperly snapped onto the bucket.

The low-friction dispenser opening allows for multiple sheet feeding. These multiple sheets, while still joined, can create a single, larger wipe.

Conclusions, Ramifications, and Scope Not Limited by Examples Used in Disclosure Accordingly, the many applications, not limited in scope to the current embodiment, are evident when reviewing the advantages of the "Wet or Dry Wipe Dispenser and Container".

The wet or dry wipe dispenser and container has the following advantages:

it permits the creation of a multitude of wipes for a multitude of differing uses;

it provides people with limited manual dexterity the ability to operate a container for multiple wiping uses;

it provides a wipe container which is rugged;

it permits the creation of wipe solutions for people with unique needs; and it permits versatility when selecting wipe media;

Although this list contains many specific advantages, these should not be understood to minimize the scope of the possible embodiments. The current embodiment of the carry-handle and cap as a single unit need to be so. According to various embodiments, the carry-handle and the cap can be separate units. Different types of caps may be employed such as a screw or hinged cap. Additionally, the carry-handle need not pivot nor snap to the bucket. Fasteners may be used to attach the carry-handle. The carry-handle may also be molded directly onto the lid. The carry-handle and cap may be manufactured from a variety of materials such as; plastic, aluminum or steel. The lid is integral to the dispenser, however it can be shaped differently. A different embodiment for the lid may be triangular or rectangular. The lid may be manufactured from a variety of materials such as; plastic, aluminum or steel. Within these differing shape embodiments, the lid conforms to the bucket with a liquid tight seal. The lid may conform to the bucket using a variety of possible embodiments such as; screws, snaps or hinge clips. The lid need not contain all of the features of the current embodiment such as; logo-panel, backstop or toothed ring.

The height, diameter and volume of the dispenser bucket may be embodied differently to accommodate different media types. The dispenser bucket may be manufactured from a variety of different materials such as; plastic, aluminum or steel.

Thus the comprehensiveness of the embodiment should be evaluated by the claims below and their legal equivalents, rather than by the examples given.

Although specific embodiments of the subject matter have been disclosed, those having ordinary skill in the art will understand that changes can be made to the specific embodiments without departing from the scope of the disclosed subject matter. The scope of the disclosure is not to be restricted, therefore, to the specific embodiments, and it is intended that the appended claims cover any and all such applications, modifications, and embodiments within the scope of the present disclosure.

What is claimed is:

1. A portable wet or dry media dispenser for wipes comprising:

a bucket to contain the media, and saturating solution if used wet;

a lid for the bucket, the lid having an opening for dispensing wipes through the lid opening, the lid additionally forms a liquid tight seal to the bucket;

and a rotatable handle cap for the lid that is rotated to cover the opening in the lid, in a closed position, and the handle cap is rotated to uncover the opening, in an open position, the rotatable handle cap is mechanically coupled with a carry-handle, the carry-handle for carrying the dispenser by the carry-handle in the closed position of the handle cap, and where the dispenser through the opening presents pop-up continuous feed wipes to a user of the dispenser as the user selects and pulls one or more media wipes from the inside of the bucket through the opening, the one or more media wipes provided in solution as saturated wet wipes form or as dry wipes form, and wherein the handle cap and carry-handle are integrally combined into a single rotatable unit that includes a pair of arms, and where the handle cap is maintained in the closed position covering the opening under tension via pressure exerted by the pair of arms each rotatably attached to the bucket, wherein the tension is configured to allow for venting of gas pressure.

2. The portable wet or dry wipe media dispenser of claim 1, wherein the bucket has one of a key feature and a mating slot, and the lid has the other one of the key feature and the mating slot, for mating the key feature with the mating slot thereby locating a correct position to attach the lid to the bucket, wherein the bucket has a pair of handle posts each with a shoulder and a snap attachment head and the handle cap has a pair of arms each having a handle pivot eye, each pivot eye attaches around a snap attachment head of one of the pair of handle posts to stand the handle from the sides of the bucket; and wherein the bucket has a transparent liquid level and media window to view liquid level inside the bucket, if used wet, and view wipe media inside the bucket, a plurality of level indicator lines within said liquid level and media window provide visual indication measurement of liquid level inside the bucket, if used wet, and remaining media volume inside the bucket.

3. The portable wet or dry wipe media dispenser of claim 1, wherein the lid includes:

a lid feed opening for dispensing through the opening wipe media for wipes;

a lid handle open feature;

a plurality of handle ramps to lift a respective plurality of arms of the handle cap on rotation of the carry-handle to the closed position of the handle cap, at least one lid handle lock recess retains the handle cap locked in the closed position until opening rotational force is applied to the carry-handle;

a handle backstop to prevent rotating the handle cap past the locked closed position;

a lid opening tab to assist removal of the lid from the bucket;

a lid handle close feature;

a lid key feature for mating with a mating slot in the bucket, to locate lid alignment to the bucket; and a toothed ring to facilitate at least one of separating perforated wipe media pulled from the dispenser; and cutting continuous wipe media pulled from the dispenser.

4. The portable wet or dry wipe media dispenser of claim 1 wherein the lid includes:

a lid handle close feature; and a lid handle open feature, the lid handle close feature and the lid handle open feature providing reference features for a user to locate their hand on the lid to facilitate closing and opening the dispenser by rotating the carry-handle and handle cap with one hand.

5. The portable wet or dry wipe media dispenser of claim 1, where the handle cap and carry-handle are integrally combined into a single rotatable unit.

6. The portable wet or dry wipe media dispenser of claim 1, where the handle cap is a separate part from the carry-handle.

7. The portable wet or dry wipe media dispenser of claim 1, where the handle cap and carry-handle are integrally combined into a single rotatable unit that includes:

the carry-handle;

the handle cap including a plurality of reinforcement ribs; and a pair of arms each having a handle pivot eye for attaching to a respective handle post in the bucket.

8. The portable wet or dry wipe media dispenser of claim 1, where the handle cap and carry-handle are integrally combined into a single rotatable unit that includes a pair of arms, and where the handle cap is maintained in the closed position covering the opening under tension via pressure exerted by the pair of arms each having a handle pivot eye, each pivot eye attached to a handle post in the bucket and pulling down the arm toward the handle post, a non-liquid tight seal being made by the handle cap to the lid while covering the opening so that gas can escape from the opening to vent gas pressure from inside the bucket while preserving the liquid tight seal between the lid and the bucket and preventing gas pressure from forcing liquid through said liquid tight seal.

9. The portable wet or dry wipe media dispenser of claim 1, where the handle cap and carry-handle are integrally combined into a single rotatable unit that includes a pair of arms each having a handle pivot eye, each pivot eye attached to a handle post in the bucket and pulling down the arm toward the handle post, and where the handle cap is maintained in the closed position covering the opening under tension via pressure exerted by the pair of arms each rotatably attached to the bucket, so that gas can escape from the opening to vent gas pressure from inside the bucket.

10. A portable media dispenser for wet wipes comprising:

a bucket to contain the media and saturating wet solution;

a lid for the bucket, the lid having an opening for dispensing wet wipes through the lid opening, the lid additionally forms a liquid tight seal to the bucket;

and a rotatable handle cap for the lid that is rotated to cover the opening in the lid, in a closed position, and the handle cap is rotated to uncover the opening, in an open position, the rotatable handle cap is integrally formed with a handle in a single rotatable unit, and where the dispenser through the opening presents wipes to a user of the dispenser as the user selects and pulls one or more media wipes from the inside of the bucket through the opening, the one or more media wipes provided in solution as saturated wet wipes form and wherein the single rotatable unit includes a pair of arms, and where the handle cap is maintained in the closed position covering the opening under tension via pressure exerted by the pair of arms each rotatably attached to the bucket, wherein the tension is configured to allow for venting of gas pressure.

11. The portable media dispenser for wet wipes of claim 10, wherein the lid includes:

a lid handle close feature; and a lid handle open feature, the lid handle close feature and the lid handle open feature providing reference features for a user to locate their hand on the lid to facilitate closing and opening the dispenser by rotating the carry-handle and handle cap with one hand.

12. A portable media dispenser for dry wipes comprising:

a bucket to contain the wipe media;

a lid for the bucket, the lid having an opening for dispensing wipes through the lid opening, the lid additionally forms a liquid tight seal to the bucket;

and a rotatable handle cap for the lid that is rotated to cover the opening in the lid, in a closed position, and the handle cap is rotated to uncover the opening, in an open position, the rotatable handle cap is integrally formed with a handle in a single rotatable unit, and where the dispenser through the opening presents wipes to a user of the dispenser as the user selects and pulls one or more media wipes from the inside of the bucket through the opening, the one or more media wipes provided in dry wipes form and wherein single rotatable unit that includes a air of arms and where the handle ca is maintained in the closed position covering the opening under tension via pressure exerted by the pair of arms each rotatably attached to the bucket, wherein the tension is configured to allow for venting of gas pressure.

13. The portable media dispenser for dry wipes of claim 12, wherein the lid includes:

a lid handle close feature; and a lid handle open feature, the lid handle close feature and the lid handle open feature providing reference features for a user to locate their hand on the lid to facilitate closing and opening the dispenser by rotating the carry-handle and handle cap with one hand.

* * * * *